United States Patent [19]

Kemp, Jr. et al.

[11] Patent Number: 4,783,218

[45] **Date of Patent: * Nov. 8, 1988**

[54] PROCESS FOR PRODUCING SPHERICAL REFRACTORY METAL BASED POWDER PARTICLES

[75] Inventors: Preston B. Kemp, Jr., Athens; Walter A. Johnson, Towanda, both of Pa.

[73] Assignee: GTE Products Corporation, Stamford, Conn.

[ * ] Notice: The portion of the term of this patent subsequent to Dec. 8, 2004 has been disclaimed.

[21] Appl. No.: 904,997

[22] Filed: Sep. 8, 1986

[51] Int. Cl.[4] ..... B22F 1/00

[52] U.S. Cl. ..... 75/0.5 BB; 264/15; 219/121.38

[58] Field of Search ..... 75/0.5 R, 0.5 B, 0.5 BB; 219/121 P, 121 PB, 121 PM; 264/15

[56] References Cited

U.S. PATENT DOCUMENTS 3,974,245 8/1976 Cheney et al. ..... 75/0.5 B
4,264,354 4/1981 Cheetham ..... 75/251
4,711,660 12/1987 Kemp, Jr. ..... 75/0.5 B
4,711,661 12/1987 Kemp, Jr. ..... 7/0.5 B

FOREIGN PATENT DOCUMENTS 02864 8/1984 European Pat. Off. ..... 75/0.5

*Primary Examiner*—Christopher W. Brody
*Attorney, Agent, or Firm*—Donald R. Castle; L. Rita Quatrini

[57] ABSTRACT

A powdered material and a process for producing the material are disclosed. The powdered material consists essentially of refractory metal based spherical particles and is essentially free of elliptical shaped material and elongated particles having rounded ends. The process for making the spherical particles involves mechanically reducing the size of a starting material to produce a finer powder which is then entrained in a carrier gas and passed through a high temperature zone at a temperature above the melting point of the finer powder to melt at least about 50% by weight of the powder and form the spherical particles of the melted portion. The powder is then directly solidified.

6 Claims, No Drawings

PROCESS FOR PRODUCING SPHERICAL REFRACTORY METAL BASED POWDER PARTICLES

CROSS REFERENCE TO RELATED APPLICATIONS

This invention is related to the following applications: Ser. No. 904,316, entitled "Fine Spherical Particles and Process for Producing Same," Ser. No. 905,015, entitled "Iron Group Based and Chromium Based Fine Spherical Particles and Process For Producing Same," Ser. No. 905,011 now U.S. Pat. No. 4,711,661, entitled "Spherical Copper Based Powder Particles and Process For Producing Same," Ser. No. 905,013 now U.S. Pat. No. 4,711,660, entitled "Spherical Precious Metal Based Powder Particles and Process For Producing Same," Ser. No. 904,318, entitled "Spherical Light Metal Based Powder Particles And Process For Producing Same," and Ser. No. 904,317, entitled "Spherical Titanium Based Powder Particles And Process For Producing Same," all of which are filed concurrently herewith and all of which are by the same inventors and assigned to the same assignee as the present application.

BACKGROUND OF THE INVENTION

This invention relates to spherical powder particles and to the process for producing the particles which involves mechanically reducing the size of a starting material followed by high temperature processing to produce spherical particles. More particularly the high temperature process is a plasma process.

U.S. Pat. No. 3,909,241 to Cheney et al relates to free flowing powders which are produced by feeding agglomerates through a high temperature plasma reactor to cause at least partial melting of the particles and collecting the particles in a cooling chamber containing a protective gaseous atmosphere where the particles are solidified.

Spherical refractory metal powders such as tungsten, molybdenum, niobium, tantalum, rhenium, and their alloys are useful in applications requiring good thermal and electrical conductivity and/or endurance at high temperatures and/or abrasive environments. Parts such as filters, precision press and sinter parts, injection molded parts, and electrical/electronic components may be made from these powders.

Refractory metal powders are generally produced by the reduction of oxides or the salts to metal resulting in nonspherical powder. Refractory based alloy powders containing difficult-to-reduce elements such as chromium, silicon, aluminum, and vanadium must be made from processes resulting in a coarse, often non-spherical powder.

Therefore, a process for efficiently converting coarse, often non-spherical refractory metal based powder to spherical powder would be an advancement in the art.

In European Patent Application No. WO8402864 published Aug. 2, 1984, there is disclosed a process for making ultra-fine powder by directing a stream of molten droplets at a repellent surface whereby the droplets are broken up and repelled and thereafter solidified as described therein. While there is a tendency for spherical particles to be formed after rebounding, it is stated that the molten portion may form elliptical shaped or elongated particles with rounded ends.

SUMMARY OF THE INVENTION

In accordance with one aspect of this invention, there is provided a powdered material which consists essentially of refractory metal based spherical particles which are essentially free of elliptical shaped material and elongated particles having rounded ends.

In accordance with another aspect of this invention, there is provided a process for producing the above described spherical particles. The process involves mechanically reducing the size of a starting material to produce a finer powder which is then entrained in a carrier gas and passed through a high temperature zone at a temperature above the melting point of the finer powder to melt at least about 50% by weight of the powder and form the spherical particles of the melted portion. The powder is then directly solidified.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The starting material of this invention is a refractory metal based material. The refractory metals on which the materials are based are tungsten, molybdenum, niobium, tantalum, and rhenium. The term "based materials" as used in this invention means any of the above described metals, or any of its alloys, withor without additions of compounds selected from the group consisting of oxides, nitrides, borides, carbides, silicides, as well as complex compounds such as carbonitrides. Some preferred refractory metal based materials of this invention are tungsten metal, tungsten heavy alloys, molybdenum alloys containing one or more elements selected from the group consisting of titanium, zirconium, and hafnium, tungsten alloyed with rhenium, and molybdenum alloyed with rhenium. For purposes of illustration, the following are given as preferred materials of this invention with the constituents being expressed in weight units: (1) tungsten alloyed with about 25% rhenium, (2) tungsten alloyed with silver or copper, (3) heavy tungsten alloys containing from about 90% to about 97% tungsten alloyed with either copper and nickel or iron and nickel plus additional elements, (4) molybdenum TZM alloys, such as molybdenum alloyed with from about 0.01% to about 0.04% carbon, from about 0.40 to about 0.55% titanium, from about 0.06% to about 0.12% zirconium, less than about 0.0025% oxygen, less than about 0.0005% hydrogen, less than about 0.002% nitrogen, less than about 0.010% iron, less than about 0.002% nickel, and less than about 0.008% silicon, (5) molybdenum alloyed with about 5%, 35% or 41% rhenium, (6) rhenium alloyed with tungsten and molybenum, (7) tantalum alloyed with silicon, (8) tantalum with additions of oxides such as thoria or yttria with or without silicon additions, (9) tantalum alloyed with tungsten and/or hafnium for example containing about 2.5%, 7.5%, and 10% tungsten, and (10) niobium alloys containing about 10% hafnium and about 1% titanium.

The size of the starting material is first mechanically reduced to produce a finer powder material. The starting material can be of any size or diameter initially, since one of the objects of this invention is to reduce the diameter size of the material from the initial size. The size of the major portion of the material is reduced to less than about 50 micrometers in diameter.

The mechanical size reduction can be accomplished by techniques such as by crushing, jet milling, attritor, rotary, or vitratory milling with attritor ball milling being the preferred technique for materials having a starting size of less than about 1000 micrometers in size.

A preferred attritor mill is manufactured by Union Process under the trade name of "The Szegvari Attritor". This mill is a stirred media ball mill. It is comprised of a water jacketed stationary cylindrical tank filled with small ball type milling media and a stirrer which consists of a vertical shaft with horizontal bars. As the stirrer rotates, balls impact and shear against one another. If metal powder is introduced into the mill, energy is transferred through impact and shear from the media to the powder particles, causing cold work and fracture fragmentation of the powder particles. This leads to particle size reduction. The milling process may be either wet or dry, with wet milling being the preferred technique. During the milling operation the powder can be sampled and the particle size measured. When the desired particle size is attained the milling operation is considered to be complete.

The particle size measurement throughout this invention is done by conventional methods as sedigraph, micromerograph, and microtrac with micromerograph being the preferred method.

The resulting reduced size material or finer powder is then dried if it has been wet such as by a wet milling technique.

If necessary, the reduced size material is exposed to high temperature and controlled environment to remove carbon and oxygen, etc.

The reduced size material is then entrained in a carrier gas such as argon and passed through a high temperature zone at a temperature above the melting point of the finer powder for a sufficient time to melt at least about 50% by weight of the finer powder and form essentially fine particles of the melted portion. Some additional particles can be partially melted or melted on the surface and these can be spherical particles in addition to the melted portion. The preferred high temperature zone is a plasma.

Details of the principles and operation of plasma reactors are well known. The plasma has a high temperature zone, but in cross section the temperature can vary typically from about 5500° C. to about 17,000° C. The outer edges are at low temperatures and the inner part is at a higher temperature. The retention time depends upon where the particles entrained in the carrier gas are injected into the nozzle of the plasma gun. Thus, if the particles are injected into the outer edge, the retention time must be longer, and if they are injected into the inner portion, the retention time is shorter. The residence time in the plasma flame can be controlled by choosing the point at which the particles are injected into the plasma. Residence time in the plasma is a function of the physical properties of the plasma gas and the powder material itself for a given set of plasma operating conditions and powder particles. Larger particles are more easily injected into the plasma while smaller particles tend to remain at the outer edge of the plasma jet or are deflected away from the plasma jet.

After the material passes through the plasma and cools, it is rapidly solidified. Generally the major weight portion of the material is converted to spherical particles. Generally greater than about 75% and most typically greater than about 85% of the material is converted to spherical particles by the high temperature treatment. Nearly 100% conversion to spherical particles can be attained. The major portion of the spherical particles are preferably less than about 50 micrometers. The particle size of the plasma treated particles is largely dependent on the size of the material obtained in the mechanical size reduction step. As much as about 100% of the spherical particles can be less than about 50 micrometers.

The spherical particles of the present invention are different from those of the gas atomization process because the latter have caps on the particles whereas those of the present invention do not have such caps. Caps are the result of particle-particle collision in the molten or semi-molten state during the gas atomization event.

After cooling and resolidification, the resulting high temperature treated material can be classified to remove the major spheroidized particle portion from the essentially nonspheroidized minor portion of particles and to obtain the desired particle size. The classification can be done by standard techniques such as screening or air classification. The unmelted minor portion can then be reprocessed according to the invention to convert it to fine spherical particles.

The powdered materials of this invention are essentially relatively uniform spherical particles which are essentially free of elliptical shaped material and essentially free of elongated particles having rounded ends. These characteristics can be present in the particles made by the process described in European Patent Application No. WO8402864 as previously mentioned.

Spherical particles have an advantage over non-spherical particles in injection molding and pressing and sintering operations. The lower surface area of spherical particles as opposed to non-spherical particles of comparable size, and the flowability of spherical particles makes spherical particles easier to mix with binders and easier to dewax.

In applications in which powders are used directly as in conversion of tungsten to tungsten carbide, the more uniformly shaped spherical powder particles of this invention enable that uniformity to be achieved in materials produced therefrom.

In electrical contacts utilizing tungsten and silver, the uniform shaped material of this invention enables comparable electrical properties to be achieved using less silver because of the packing efficiency of the uniform particles and their lower surface area.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process comprising:

(a) mechanically reducing the size of a refractory metal based material to produce a finer powder;

(b) entraining said finer powder in a carrier gas and passing said powder through a high temperature zone at a temperature above the melting point of said finer powder, said temperature being from about 5500° C. to about 17,000° C., said temperature being created by a plasma jet, to melt at least about 50% by weight of said finer powder to form essentially spherical particles of said melted portion; and (c) rapidly and directly resolidifying the resulting high temperature treated material, while said material is in flight, to form spherical particles, said particles being essentially free of elliptical shaped material and essentially free of elongated particles having rounded ends.

2. A process of claim 1 wherein the size of said material is reduced by attritor milling said material to produce said finer powder.

3. A process of claim 1 wherein after said resolidification, said high temperature treated material is classified to obtain the desired particle size of said spherical particles.

4. A process of claim 1 wherein said refractory metal based material is a metal selected from the group consisting of tungsten, molybdenum, niobium, tantalum, and rhenium.

5. A process of claim 1 wherein said refractory metal based material is an alloy selected from the group consisting of tungsten alloys, molybdenum alloys, niobium alloys, tantalum alloys, and rhenium alloys.

6. A process of claim 1 wherein said refractory metal based material is selected from the group consisting of tungsten metal, tungsten heavy alloys, molybdenum alloys containing one or more elements selected from the group consisting of titanium, zirconium, and hafnium, tungsten alloyed with rhenium, and molybdenum alloyed with rhenium.

* * * * *